US007635069B2

(12) United States Patent
Spears

(10) Patent No.: US 7,635,069 B2
(45) Date of Patent: Dec. 22, 2009

(54) APPARATUS FOR DISTRIBUTING A BEVERAGE

(76) Inventor: David J. Spears, 119 N. Walnut, Champaign, IL (US) 61820

( * ) Notice: Subject to any disclaimer, the term of this patent is extended or adjusted under 35 U.S.C. 154(b) by 714 days.

(21) Appl. No.: 11/301,068

(22) Filed: Dec. 12, 2005

(65) Prior Publication Data

US 2006/0124664 A1 Jun. 15, 2006

Related U.S. Application Data

(60) Provisional application No. 60/636,324, filed on Dec. 15, 2004.

(51) Int. Cl.
*B67D 1/16* (2006.01)

(52) U.S. Cl. ..... 222/108; 222/130; 222/131; 222/146.6; 222/185.1

(58) Field of Classification Search ..... 222/108, 222/129.1, 130–132, 185.1, 183, 146.6, 181.1
See application file for complete search history.

(56) References Cited

U.S. PATENT DOCUMENTS 683,915 A * 10/1901 Dinn ..... 222/336
1,038,021 A * 9/1912 Summers ..... 239/29.3
1,377,630 A * 5/1921 Royster ..... 222/108
1,776,054 A * 9/1930 Tuttle ..... 141/82
1,940,271 A * 12/1933 Renfrew ..... 222/108
2,058,027 A * 10/1936 Martinet ..... 222/131
2,144,004 A * 1/1939 Wilson ..... 62/258
2,144,005 A * 1/1939 Wilson ..... 62/258
2,362,104 A 11/1944 Smith
2,430,501 A 11/1947 Galbally
2,628,009 A 2/1953 Idzi
2,649,997 A * 8/1953 Klenk ..... 222/108
3,302,831 A * 2/1967 Matheney ..... 222/108
3,790,032 A 2/1974 George
4,094,445 A 6/1978 Bevan
5,564,602 A 10/1996 Cleland et al.
5,921,445 A * 7/1999 Schmitz et al. ..... 222/385
6,047,866 A 4/2000 Brown
6,481,238 B1 * 11/2002 Jennings et al. ..... 62/457.4
2002/0092873 A1 7/2002 Garson
2004/0007276 A1 1/2004 Sugg

OTHER PUBLICATIONS

Classic Washfountain Semi-Circular w/9" Deep Bowl; Plumbing Fixtures Technical Data Sheet of Bradley Corporation (4 pages).
Pope, Jeff "Restaurant Offers 160 Types of Beer," article in the Las Vegas Home News, Feb. 2008 (1 page).

* cited by examiner

*Primary Examiner*—Frederick C. Nicolas
(74) *Attorney, Agent, or Firm*—Barnes & Thornburg LLP

(57) ABSTRACT

An apparatus for distributing a beverage includes a dispenser configured to be mounted to a shaft. The shaft is surrounded on a lower portion by a base. The dispenser is arranged having a number of discharge ports mounted in a 360-degree orientation. The discharge port arrangement allows a number of operators to distribute beverage without interfering with each other.

18 Claims, 2 Drawing Sheets

APPARATUS FOR DISTRIBUTING A BEVERAGE

This present application claims benefit of U.S. Provisional Patent Application Ser. No. 60/636,324, filed Dec. 15, 2004, which application is hereby incorporated by reference herein.

BACKGROUND

The present disclosure relates generally to beverage dispensers, and more particularly to fountain-type beverage dispensers.

Fountain-type beverage dispensers are used in a variety of settings. A number of beverage dispensers allows a greater quantity of patrons to be served simultaneously. Coupling a number of individual dispensers to a single hub or drum allows numerous servers to access the beverage dispensers without interfering with each other.

SUMMARY

The present disclosure may comprise one or more of the features recited in the claims, and/or one or more of the following features and combinations thereof. An apparatus for distributing a beverage may comprise a dispenser having a drum coupled to an upper portion of a shaft and a number of discharge ports coupled to the drum. The shaft may comprise a hollow cylinder configured to receive a liquid supply tube coupled to one end of a supply source, and on another end, to the number of discharge ports coupled to the drum.

The dispenser may further include a platform coupled to the shaft below the drum. The platform may provide means for supporting a beverage receptacle so that a server does not have to hold the receptacle when filling it from the discharge ports.

The dispenser may further include a basin surrounding a lower portion of the shaft to collect any liquid which is spilled in the process of filling the beverage receptacle. The basin may further include a water supply line and a waste outlet. The water supply line may be a pipe configured to deliver tap water to the base for cleaning, for example. The waste outlet may be a pipe configured to allow waste liquids to exit the basin and flow to an appropriate waste collection system.

Additional features of the disclosure will become apparent to those skilled in the art upon consideration of the following detailed description of illustrative embodiments.

DETAILED DESCRIPTION

Figure 1:
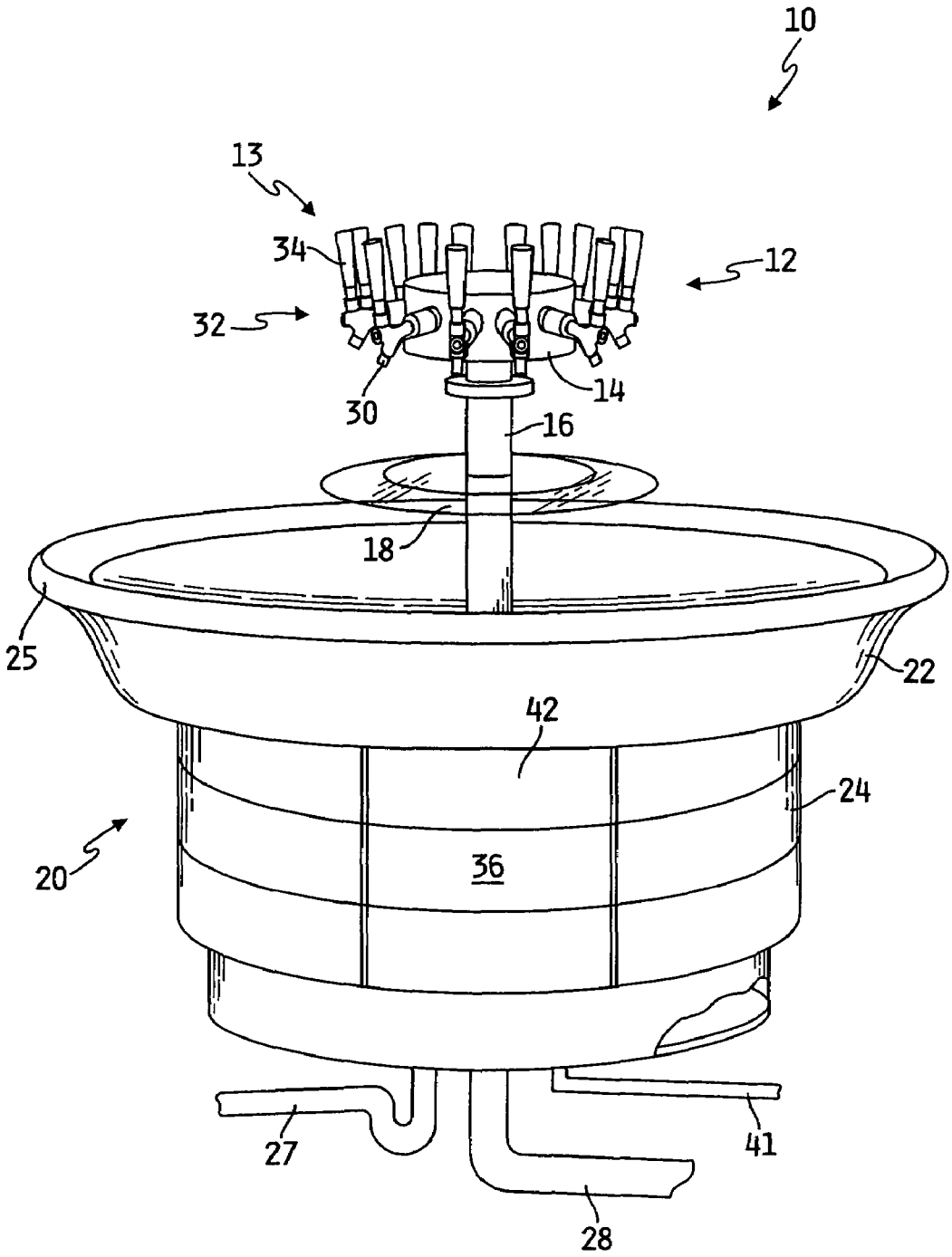
FIG. 1 is a perspective view of the apparatus for distributing a beverage including a number of discharge ports coupled to a drum, the drum coupled to an upper portion of a shaft, the shaft surrounded on a lower portion by a concentrically arranged basin to collect liquids spilled in the distribution process, and the basin being formed to include a hinged door panel, a water supply line, and a waste outlet.

For the purposes of promoting an understanding of the principles of the disclosure, reference will now be made to one or more illustrative embodiments illustrated in the drawing and specific language will be used to describe the same.

Referring to FIG. 1, an apparatus for distributing a beverage 10 is shown and includes a dispenser 12, a shaft 16, and a basin 20. Dispenser 12 includes a number of discharge ports 13 coupled to a drum 14. Drum 14 is coupled to an upper portion of shaft 16 in a conventional manner. A lower portion of shaft 16 is coupled to basin 20.

An upper portion of shaft 16 is arranged having drum 14 coupled to the upper portion of shaft 16, the lower portion of shaft 16 is coupled to basin 20, and a beverage receptacle platform 18 coupled to shaft 16 therebetween. In the illustrative embodiment, beverage receptacle platform 18 is an annular tray or annular plate 18 formed to include an aperture at its center arranged to receive shaft 16. Tray 18 extends radially outwardly away from shaft 16 to provide a surface for a server to place a beverage container (not shown) below discharge ports 13 so that the server can fill the container without having to hold the container during the distribution process.

Illustratively, shaft 16 is formed to include a hollow bore configured to receive a supply tube 28 coupled to a supply source (not shown) located away from apparatus 10. Supply tube 28 extends through the lower portion of shaft 16 to an upper portion of shaft 16 where it is coupled to discharge ports 13 for fluid communication between shaft 16 and discharge ports 13.

Each discharge port 13 includes a spigot 30, a control valve 32, and a control valve actuator 34. Spigot 30 allows a beverage to be dispensed out discharge port 13 to a beverage container. Control valve 32 is configured to control the flow of beverage from supply tube 28 to the beverage container. Control valve actuator 34 is arranged to allow a server to manually operate control valve 32. In the illustrative embodiment, actuator 34 is a palm-receiving rod.

Figure 2:
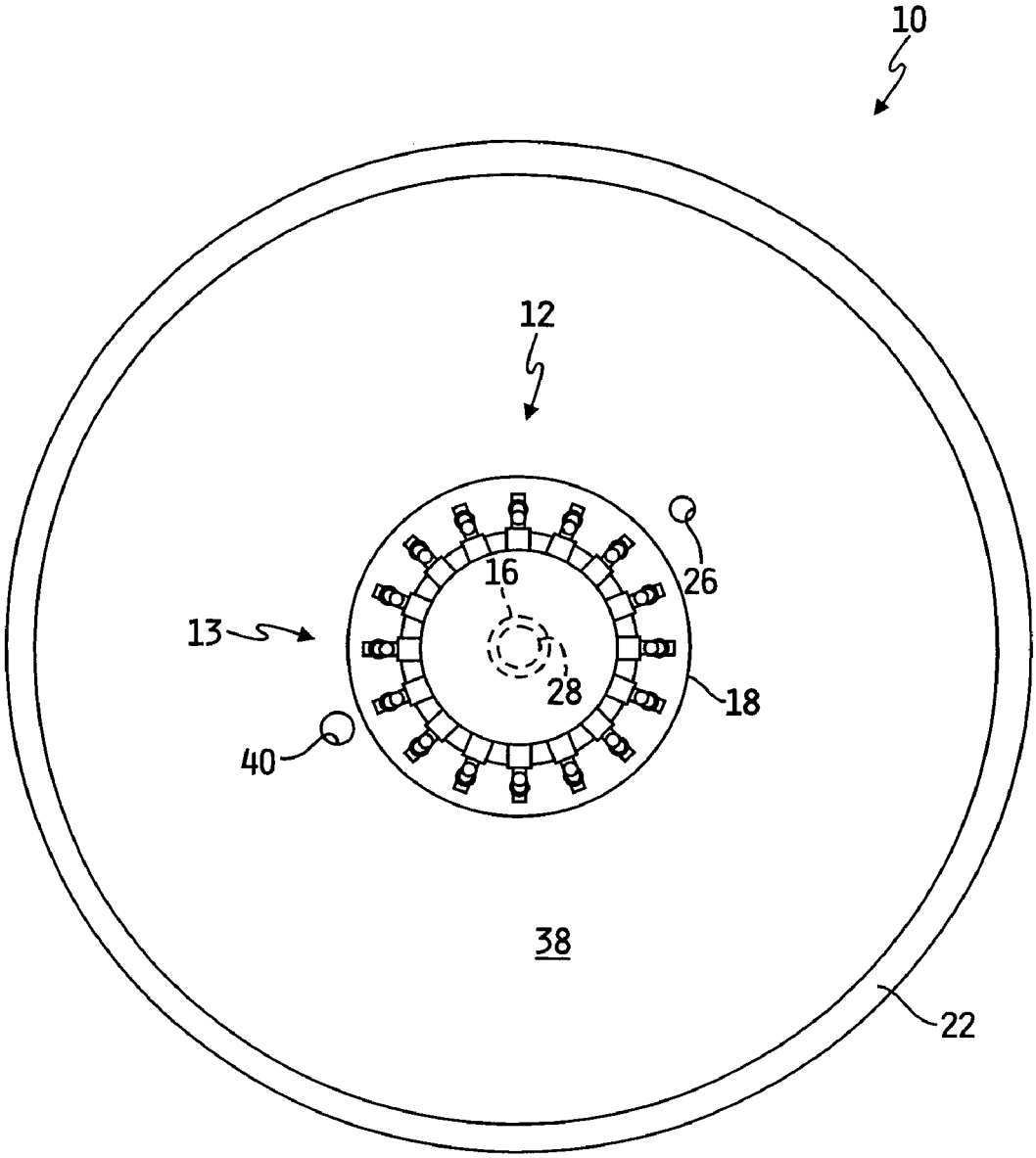
FIG. 2 is a plan view of the apparatus for distributing a beverage of FIG. 1, with portions broken away, showing the number of discharge ports arranged in a spaced-apart relationship generally 360 degrees around the drum, the concentrically arranged basin surrounding a lower portion of the apparatus, and the waste outlet.

Referring now to FIG. 2, discharge ports 13 are arranged in a spaced-apart relation to one another around drum 14 in a generally 360-degree orientation. The 360-degree orientation provides means for a number of servers to access dispenser 12 simultaneously so that they do not interfere with each other while filling beverage containers. Illustratively, sixteen ports 13 are shown. However, it is within the scope of this disclosure to include a dispenser 12 having any number of discharge ports 13.

Basin 20 includes an outer side wall 36 and a bottom wall 38 cooperating to define an interior region 29. Outer side wall 36 is configured having an upper portion 22 and a lower portion 24. Bottom wall 38 is formed to include an outlet 26 associated with a drain pipe 27. Bottom wall 38 may include an inlet aperture 40 to provide, for example, means for supplying a fresh water source such as an inlet pipe 41. Upper portion 22 is generally frustoconical in shape having a wide-diameter top end and a narrow-diameter bottom end. Upper portion 22 is coupled to lower portion 24 to form a unitary structure. Lower portion 24 is generally cylindrically-shaped. Outer side wall 36 may be formed to include a hinged door panel 42 to allow access to interior region 29 of basin 20. It will be understood that while a single hinged door panel is illustrated in FIG. 1, outer side wall 36 may alternatively include more hinged door panels for access to interior region 29 of basin 20. Illustratively, an upper rim 25 of upper portion 22 defines a mouth of basin 20 that is wider than or includes a diameter greater than the drum with spigot 30 and the tray 18.

Bottom wall 38 is formed to include apertures arranged to receive shaft 16, drain pipe 27, and water supply line 41. In the illustrated embodiment, water supply line 41 extends through aperture 40. Water supply line 41 may be configured so that a source of water is provided, for example, to clean basin 20 or other components of dispenser 12. Bottom wall 38 may be generally conically-shaped to allow waste liquids to reach outlet 26.

Although a generally circular drum 12, tray 18, and basin 20 are shown, it should be understood that each of the drum 12, tray 18, and/or basin 20 may be configured in any other suitable shape such as, for example, an oval, a square, a rectangle, a triangle, etc. In the case of a square drum, for example, the discharge ports 13 may be spaced-apart along the four walls of the drum. It should also be understood, therefore, that such discharge ports 13 positioned along the four walls of the square drum may be considered to be arranged in a generally 360-degree orientation around the drum.

In an alternate embodiment contemplated by this disclosure, supply tube 28 is arranged to depend from an overhead source. In this embodiment, supply tube 28 is configured to be coupled to dispenser 12 on an upper portion of drum 14.

While the disclosure has been illustrated and described in detail in the foregoing drawings and description, the same is to be considered as illustrative and not restrictive in character, it being understood that only illustrative embodiments thereof have been shown and described and that all changes and modifications that come within the spirit of the disclosure are desired to be protected.

The invention claimed is:

1. An apparatus for distributing a beverage comprising a dispenser configured to be coupled to a shaft, the dispenser having a number of discharge ports coupled to a perimeter of a drum in a spaced-apart relation to one another, a beverage receptacle platform coupled to the shaft and arranged in spaced-apart relation below the drum and directly below the number of discharge ports, and a basin including an outer side wall and a bottom wall, the basin surrounding a lower portion of the shaft, the outer side wall and the bottom wall cooperating to define an interior region, the bottom wall being further formed to include an aperture to allow discharge of waste liquids from the basin.

2. The apparatus for distributing a beverage of claim 1, wherein the number of discharge ports are arranged in a 360-degree orientation around the drum.

3. The apparatus for distributing a beverage of claim 1, wherein the shaft is formed to include a hollow axial bore configured to receive a beverage supply tube therewithin.

4. The apparatus for distributing a beverage of claim 1, wherein the beverage receptacle platform includes a plate coupled to the shaft below the drum, the plate extending horizontally away from the shaft and configured to support a beverage receptacle in a position beneath the discharge port to receive a beverage from the discharge port.

5. The apparatus for distributing a beverage of claim 1, wherein each discharge port includes a spigot and a control valve coupled to the spigot, the control valve having a control valve actuator and configured to control the flow of the beverage from the spigot, the control valve actuator configured to allow a user to operate the control valve so that the beverage can be dispensed from the spigot.

6. The apparatus for distributing a beverage of claim 5, wherein each control valve actuator is a palm-receiving rod.

7. The apparatus for distributing a beverage of claim 1, wherein the outer side wall includes a frustoconical upper portion coupled to a cylindrical lower portion to form a unitary structure.

8. The apparatus for distributing a beverage of claim 7, wherein the basin further includes a first aperture to receive a supply line and a second aperture to receive a waste outlet.

9. An apparatus for distributing a beverage comprising a central tower, a dispenser mounted on the central tower including a drum and a number of taps arranged in 360-degree spaced-apart relation around the drum, and a basin coupled to the central tower and including an outer side wall and a bottom wall formed to include an outlet, the basin being arranged concentrically with the central tower, the central tower extending upwardly from a center portion of the basin, wherein the dispenser includes a supply line in fluid communication with the number of taps and configured to be coupled to a beverage source, and wherein the central tower is a hollow shaft configured to receive the supply line.

10. The apparatus for distributing a beverage of claim 9, wherein a beverage receptacle platform is coupled to the central tower below the number of taps, the beverage receptacle platform extending horizontally away from the central tower and configured to receive a beverage receptacle thereon to position the beverage receptacle beneath the number of taps to receive a beverage from the number of taps.

11. The apparatus for distributing a beverage of claim 9, wherein the basin is concentrically arranged with the dispenser.

12. The apparatus for distributing a beverage of claim 11, wherein the bottom wall is conically-shaped to drain liquids toward the outlet.

13. The apparatus for distributing a beverage of claim 9, wherein the drum of the dispenser is annular.

14. The apparatus for distributing a beverage of claim 9, wherein the drum of the dispenser is rectangular.

15. The apparatus for distributing a beverage of claim 9, wherein the supply line is coupled to the dispenser and arranged to depend from an overhead structure.

16. An apparatus for distributing a beverage comprising a vertical shaft including a supply line adapted to be coupled to a beverage supply source, a drum mounted to the vertical shaft including a number of discharge ports arranged in spaced-apart relation 360-degrees around the drum, the discharge ports being in fluid communication with the supply line, a beverage receptacle platform coupled to the vertical shaft below the drum and extending radially outwardly therefrom, and a basin coupled to the vertical shaft having a waste outlet, the basin positioned below the beverage receptacle platform, concentrically aligned with the drum and having a mouth portion wider than the drum and a conically-shaped bottom wall to allow fluid access to the waste line.

17. The apparatus for distributing a beverage of claim 16, further comprising a water supply line coupled to the basin.

18. The apparatus for distributing a beverage of claim 16, wherein the basin includes a port to provide access to an interior portion of the basin.

* * * * *